US005392380A

United States Patent [19]

Tsai

[11] Patent Number: 5,392,380

[45] Date of Patent: Feb. 21, 1995

[54] THERMOSTATICALLY CONTROLLED ELECTRIC AQUARIUM HEATER HAVING AN ADJUSTABLE OVERTEMPERATURE SAFETY BIMETALLIC CIRCUIT BREAKER

[76] Inventor: Hsien-Tang Tsai, P.O. Box 55-1670, Taipei, Taiwan, Prov. of China

[21] Appl. No.: 112,305

[22] Filed: Aug. 27, 1993

[51] Int. Cl.[6] ..... H05B 3/80

[52] U.S. Cl. ..... 392/498; 219/523

[58] Field of Search ..... 219/523; 392/497, 498, 392/447, 448

[56] References Cited

U.S. PATENT DOCUMENTS

| | | | |
|---|---|---|---|
| 1,992,635 | 2/1935 | Ritterhoff et al. | 219/523 X |
| 2,839,660 | 6/1958 | Davies | 219/523 X |
| 3,107,289 | 10/1963 | Willinger | 219/523 X |
| 3,746,836 | 7/1973 | Summerfield et al. | 219/523 X |
| 3,895,217 | 7/1975 | Hall et al. | 219/523 |
| 4,234,785 | 11/1980 | Lefebvre | 219/523 |
| 4,327,281 | 4/1982 | Jager et al. | 219/523 |
| 5,113,057 | 5/1992 | Tsai | 392/498 X |

*Primary Examiner*—Teresa J. Walberg

[57] ABSTRACT

An aquarium safety heater includes an adjusting screw rotatably held in a packing plug which is sealably secured in an upper portion of glass tube. A heating coil, a thermostat, a bimetal circuit breaker, and an electric controller are mounted within the glass tube. The adjusting screw is adjustable from the exterior of the glass tube for adjusting the electric contact pressure of the bimetal for ensuring reliable operation of the circuit breaker and the electric controller for safely switching off the power supply to the heating coil once the thermostat is out of order, thereby preventing the killing of fish raised in the aquarium.

2 Claims, 4 Drawing Sheets

THERMOSTATICALLY CONTROLLED ELECTRIC AQUARIUM HEATER HAVING AN ADJUSTABLE OVERTEMPERATURE SAFETY BIMETALLIC CIRCUIT BREAKER

BACKGROUND OF THE INVENTION

This application is an improvement based upon a "Doubly-controlled Aquarium Safety Heater" of U.S. Pat. No. 5,113,057 (hereinafter designated as "prior art") also granted to the same inventor of this application.

The prior art taught an aquarium heater including a heating coil and a thermostat formed in a glass tube, a thermo-sensitive resistor remotely connected to the thermostat for ensuring a reliable sensing of water temperature in the aquarium without being thermally influenced by the heating coil, and a thermal type circuit breaker provided in a circuit of the thermostat and the heating coil for safely switching off a power supply to the heating coil once the thermostat is out of order to prevent killing of fishes raised in the aquarium.

The thermal type circuit breaker when made with bimetal strip and once sealed into the glass tube will not be adjustable. For instance, when it is intended to adjust an electrical contact pressure between the contactors of the bimetal circuit breaker, it will not be accessible from the exterior of the tube to adjust such contactors.

SUMMARY OF THE INVENTION

The object of the present invention is to provide an aquarium safety heater including an adjusting screw rotatably held in a packing plug sealably secured in an upper portion of a glass tube having a heating coil, a thermostat and a thermal type circuit breaker of an electric controller mounted within the glass tube. The adjusting screw is adjustable for adjusting the electrical contact pressure between the thermal type circuit breaker and a circuit of the electric controller for ensuring a reliable operation of the circuit breaker and the electric controller for safely switching off a power supply to the heating coil once the thermostat is out of order, thereby preventing killing of fishes raised in the aquarium.

DETAILED DESCRIPTION

Figure 1:
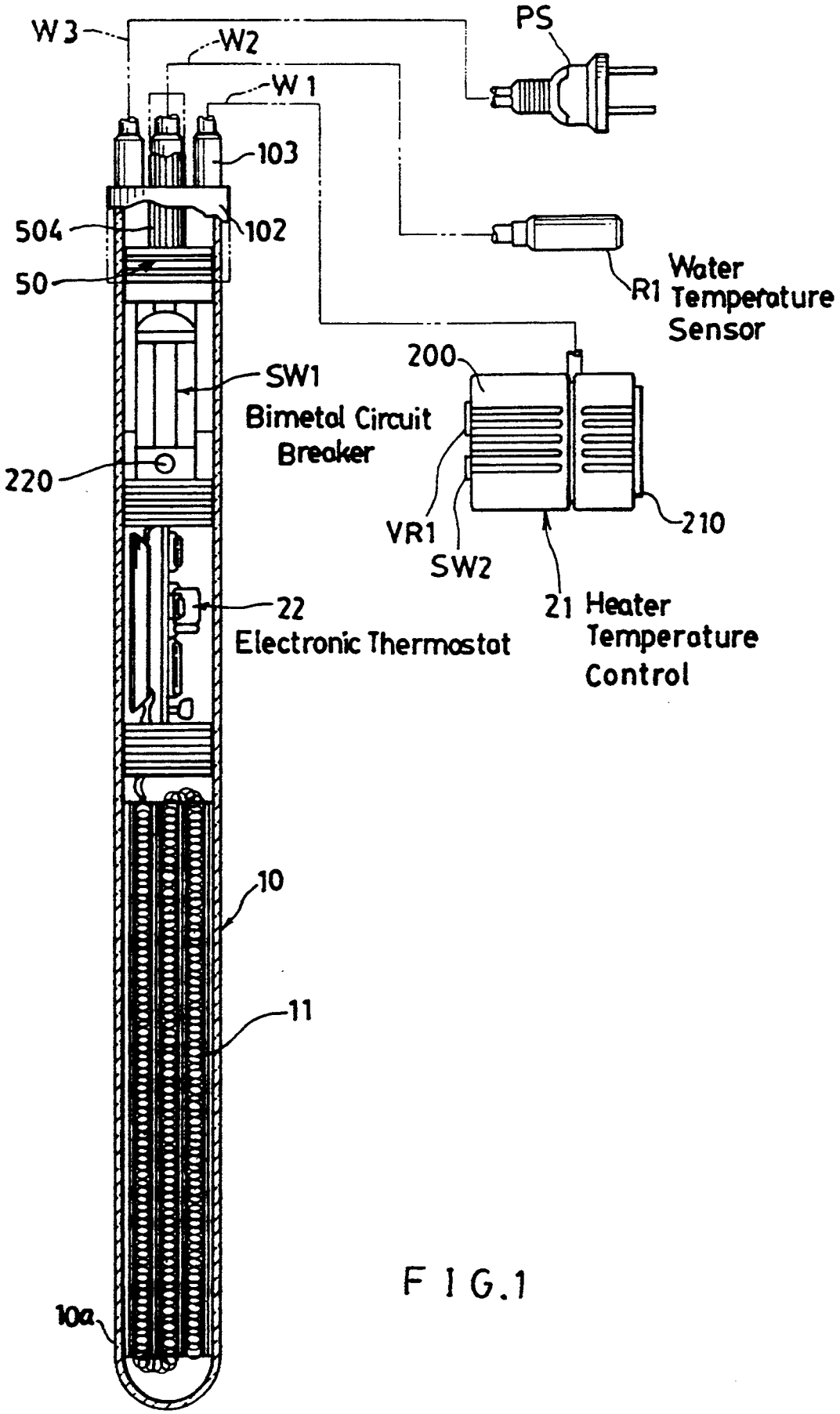
FIG. 1 is an illustration showing an assembled aquarium heater in accordance with the present invention.
Figure 2:
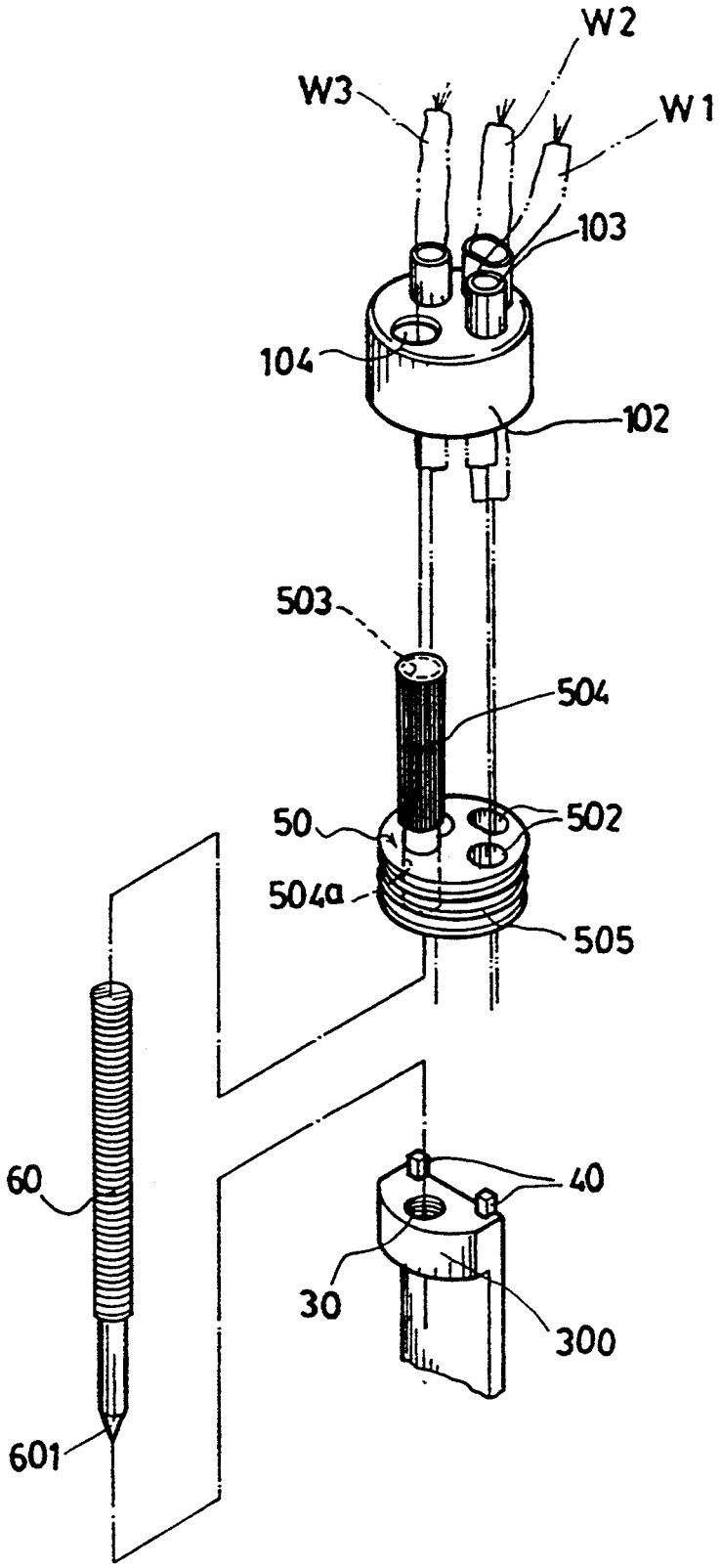
FIG. 2 is an exploded view of the elements in construction of the present invention.
Figure 3:
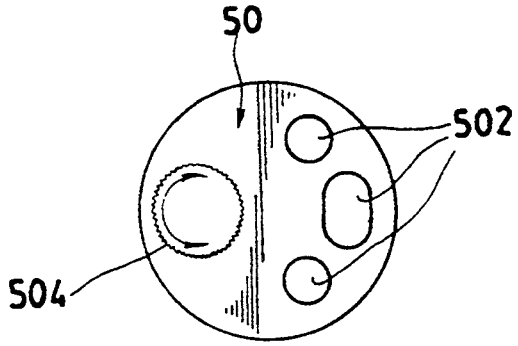
FIG. 3 is a top view of a packing plug of the present invention.
Figure 4:
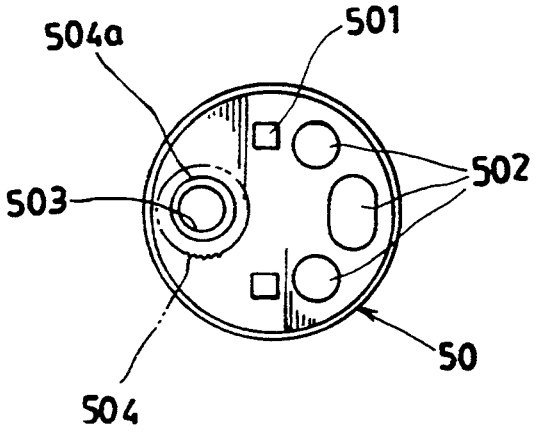
FIG. 4 shows a bottom view of the packing plug.
Figure 5:
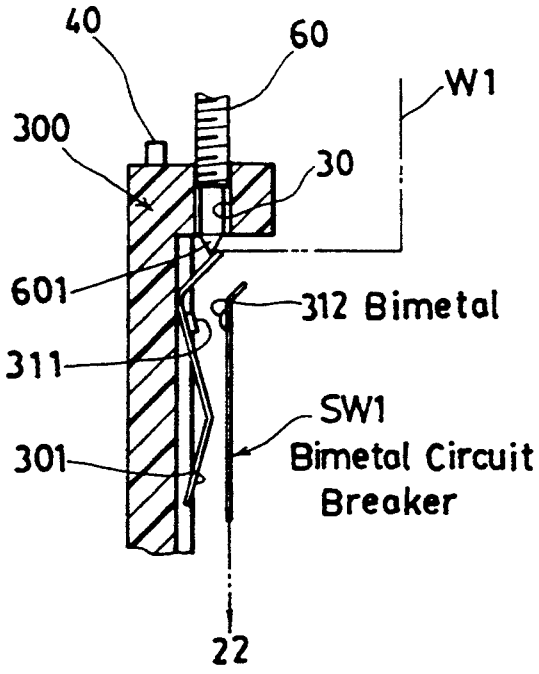
FIG. 5 is a partial illustration showing the circuit breaker and the adjusting screw of the present invention.

As shown in the drawing figures: the present invention comprises: a glass tube 10 immersed in an aquarium filled with water therein, a heating coil 11, an electric controller 21, and a power source PS, with the electric controller 21 having a thermal type bimetallic overtemperature safety circuit breaker SW1 provided with an adjusting screw 60 thereon.

The glass tube 10 includes a lower section 10*a* for installing the heating coil 11 therein, a cap 102 formed on a top portion of the tube 10 for sealing the tube 10, and a plurality of adapters 103 formed on the cap 102 for connecting a power source PS and electric controller 21 by wires W3 and W1 respectively.

The electric controller 21 includes: an electronic thermostat 22 formed in a middle section of the glass tube 10, the thermal type circuit breaker SW1 formed in an upper section of the tube 10, and an on-off switch SW2 formed on a casing of the controller 21 for switching on or off of the power source PS connected to the glass tube by wire W3.

The thermostat 22 includes electrical and electronic elements similar to those elements as described in U.S. Pat. No. 5,113,057 including a thermo-sensitive resistor R1 electrically connected to the power source and remotely connected to comparator integrated circuit through a wire W2 for serving as a sensor operatively sensing water temperature in the aquarium.

The thermal type circuit breaker SW1 includes a bimetallic element normally connected between a first pole or a positive pole of the power source through a spring contactor 301 and a first terminal 22*a* of the thermostat 22 which is electrically connected to the heating coil 11 for heating aquarium water and then grounded, with the thermostat 22 having a second terminal connected to a second pole or a negative pole of the power source. The bimetallic element of the circuit breaker SW1 is thermally biased as shown in dotted line of FIG. 6 due to an increasing temperature in the aquarium when the thermostat is out of order to disconnect the first terminal 22*a* of the thermostat 22 from the first pole of the power source to disconnect power supplied to the heating coil 11 for safety purpose. The spring contactor 301 is electrically connected to the controller casing 200 having a control knob of variable resistor VR1 and the on-off switch SW2 formed on the controller casing 200.

The spring contactor 301 has a spring-contactor protrusion 311 formed thereon operatively contacting a breaker contactor protrusion 312 formed on the bimetal of circuit breaker SW1. The spring contactor 301 is depressed by a lower probe portion 601 of an adjusting screw 60 adjustably held in a screw holder 300 which is secured to a packing plug 50 sealably secured in an upper portion of the glass tube 10 which is capped by the cap 102.

The adjusting screw 60 is engageably held in a screw hole 30 having female threads formed in the screw holder 300 having a pair of lugs 40 secured to a pair of lug holes 501 formed in a bottom portion of the packing plug 50 made of elastomer or packing material.

The adjusting screw 60 is jacketed in an upper hole 503 formed in a rotatable sleeve 504 rotatably engageable in a sleeve hole 504*a* formed in the plug 50, whereby upon a rotation of the sleeve 504 to rotate the screw 60 to lower or raise the probe portion 601 formed on a lower portion of the screw 60 for downwardly depressing the spring contactor 301 to contact the bimetallic element of the circuit breaker SW1 for electrically connecting the thermostat 22 to the knob VR1 of controller 21 and switch SW2 of power source for normally powering the heating coil 11 for normally heating aquarium water.

The packing plug 50 is circumferentially formed with concentric corrugated rings 505 thereon to be sealably secured in the upper portion of the glass tube 10 by the aid of sealant or adhesive.

The rotatable sleeve 504 having the adjusting screw 60 coupled therein is protruded upwardly through a sleeve opening 104 formed in the cap 102 adjacent to the adapters 103 for passing wires W1, W2 and W3 through the adapters 103. The plug 50 is formed with plural wire holes 502 for passing the wires W1, W2, W3 inwardly in the glass tube 20 for electrically connecting the relevant elements in the tube 10.

Figure 6:
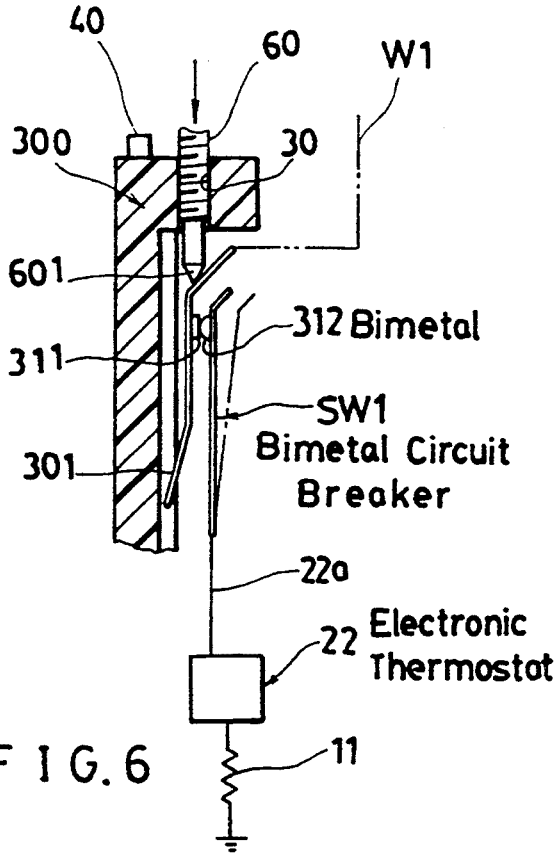
FIG. 6 is an illustration showing an adjustment of the present invention.
Figure 7:
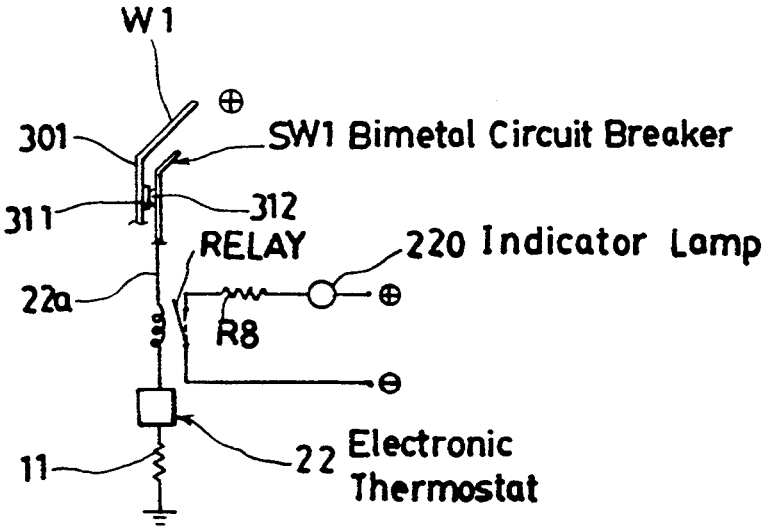
FIG. 7 shows a circuit of a warning lamp of the present invention.

When the thermostat 22 is out of order, unable to switch off the coil 11 under heating, the bimetal circuit breaker SW1 will be thermally biased as shown in dotted line of FIG. 6 to disconnect the power to the coil 11 for safety purpose. The circuit breaker SW1 may be electrically connected to the thermostat 22 and the coil 11 through a normally-open relay RELAY as shown in FIG. 7 for operatively attracting a contactor switch of a warning lamp 220 connected between two poles of the power source through a resistor R8 to switch off the lamp 220 when the coil 11 is under normal heating as (solid line) shown in FIG. 6.

However, when the circuit breaker SW1 is biased due to out of order of the thermostat 22 to disconnect the power supply to the thermostat, the normally-open relay RELAY will be closed to light the lamp 220 for reminding a repair work for the thermostat 22.

Even though the plug 50 and the cap 102 is sealed on the top of the glass tube 10 for water-proof purpose, an adjustment for adjusting the contacting of the circuit breaker SW1 of the thermostat 22 can still be effected to have a more reliable operation of the aquarium heater and thermostat to be superior to the prior art of the aquarium heater such as disclosed in U.S. Pat. No. 5,113,057.

The circuit breaker SW1 and its warning lamp 220 may be modified without departing from the spirit and scope of this invention.

I claim:

1. In an aquarium safety heater comprising:

a glass tube immersible in an aquarium filled with water and having a heating coil formed in a lower section of said glass tube;

an electric controller including an electronic thermostat in said tube for activating said heating coil for warming water in the aquarium, an adjusting knob and an on-off switch formed in a casing mountable on the aquarium for adjusting the heating temperature maintained in the aquarium by said thermostat and for switching off or on of a power source for said heating coil, a thermo-sensitive resistor remotely connected to said thermostat for sensing water temperature in the aquarium, and a thermal type over-temperature safety circuit breaker operatively switching off said thermostat when said thermostat is out of order;

the power source being electrically connected to said electric controller through an adapter formed on a cap sealably formed on a top portion of said glass tube for powering said electric controller;

said thermal type circuit breaker being connected between a first pole of said power source and a first terminal of said thermostat, a second terminal of said thermostat being connected to a second pole of said power source, said circuit breaker being thermally biased due to an increasing temperature in the aquarium when the thermostat is out of order to disconnect said first terminal of said thermostat from said first pole of said power source to disconnect said power source from said heating coil for safety purpose;

the improvement which comprises:

said thermal type circuit breaker normally contacting a spring contactor adjustably depressed by an adjusting screw rotatably held in a screw holder secured to a packing plug inserted in a upper portion of said glass tube under said cap sealing the top portion of said glass tube, said adjusting screw jacketed in sleeve rotatably engageable in said packing plug, said rotatable sleeve protruding upwardly through said cap for rotatable adjustment from outside the glass tube; in which rotataion of the screw adjusts the electrical contact pressure between the thermal circuit breaker and the spring contactor for setting the temperature at which the thermal type safely circuit breaker operates to deenergize the heating coil should the thermostat fail to operate.

2. An aquarium safety heater according to claim 1, wherein said adjusting threaded screw is rotatably engaged in a screw hole formed in said screw holder and having a plurality of lugs formed on said screw holder engageably secured to a plurality of lug holes formed in a bottom portion of said packing plug and said plug having a plurality of corrugated rings concentrically formed on a circumferential surface of said plug to be sealably secured in the upper portion of said glass tube.

* * * * *